US006171074B1

(12) United States Patent
Charron

(10) Patent No.: US 6,171,074 B1
(45) Date of Patent: Jan. 9, 2001

(54) SINGLE-SHAFT COMPRESSION-PUMPING DEVICE ASSOCIATED WITH A SEPARATOR

(75) Inventor: Yves Charron, Gabriel Faure (FR)

(73) Assignee: Institut Francais du Petrole, Rueil-Malmaison cedex (FR)

( * ) Notice: Under 35 U.S.C. 154(b), the term of this patent shall be extended for 0 days.

(21) Appl. No.: 09/238,587

(22) Filed: Jan. 28, 1999

(30) Foreign Application Priority Data

Jan. 28, 1998 (FR) ..... 98 00933

(51) Int. Cl.[7] ..... F04B 39/00; F04D 31/00; F04D 17/12

(52) U.S. Cl. ..... 417/313; 415/169.1; 415/169.2; 210/96.1; 210/195

(58) Field of Search ..... 417/313, 86; 415/169.1, 415/169.2; 418/88, DIG. 1; 210/96.1, 195, 196, 208, 213, 214, 217, 96.2

(56) References Cited

U.S. PATENT DOCUMENTS

| | | | | |
|---|---|---|---|---|
| 2,276,824 | | 3/1942 | Garruthers . | |
| 4,971,529 | * | 11/1990 | Gannaway et al. | 417/313 |
| 4,981,175 | | 1/1991 | Powers . | |
| 5,051,072 | * | 9/1991 | Yano et al. | 417/435 |
| 5,064,452 | * | 11/1991 | Yano et al. | 96/214 |
| 5,085,561 | * | 2/1992 | Yano et al. | 417/313 |
| 5,551,845 | * | 9/1996 | Milam | 417/290 |
| 5,575,615 | * | 11/1996 | Mohn | 415/74 |
| 5,580,214 | * | 12/1996 | Mohn | 415/64 |
| 5,873,709 | * | 2/1999 | Cornut et al. | 417/381 |

FOREIGN PATENT DOCUMENTS

| | | |
|---|---|---|
| 2608705 | 9/1977 | (DE) . |
| 2333139 | 6/1977 | (FR) . |
| 2471501 | 6/1981 | (FR) . |
| 2665224 | 1/1992 | (FR) . |
| 9313318 | 7/1993 | (WO) . |

* cited by examiner

*Primary Examiner*—Teresa Walberg
*Assistant Examiner*—Jeffrey C Pwu
(74) *Attorney, Agent, or Firm*—Antonelli, Terry, Stout & Kraus, LLP.

(57) ABSTRACT

A compression-pumping system for a multiphase fluid (GLR) includes a compression section, a pumping section, a shaft and a separator. The compression section is sealed off from the pumping section, and the pumping section and the compression section are included in the same enclosure and mounted on the same shaft. The compression-pumping system is associated with a liquid level control system situated at the level of the separator.

10 Claims, 6 Drawing Sheets

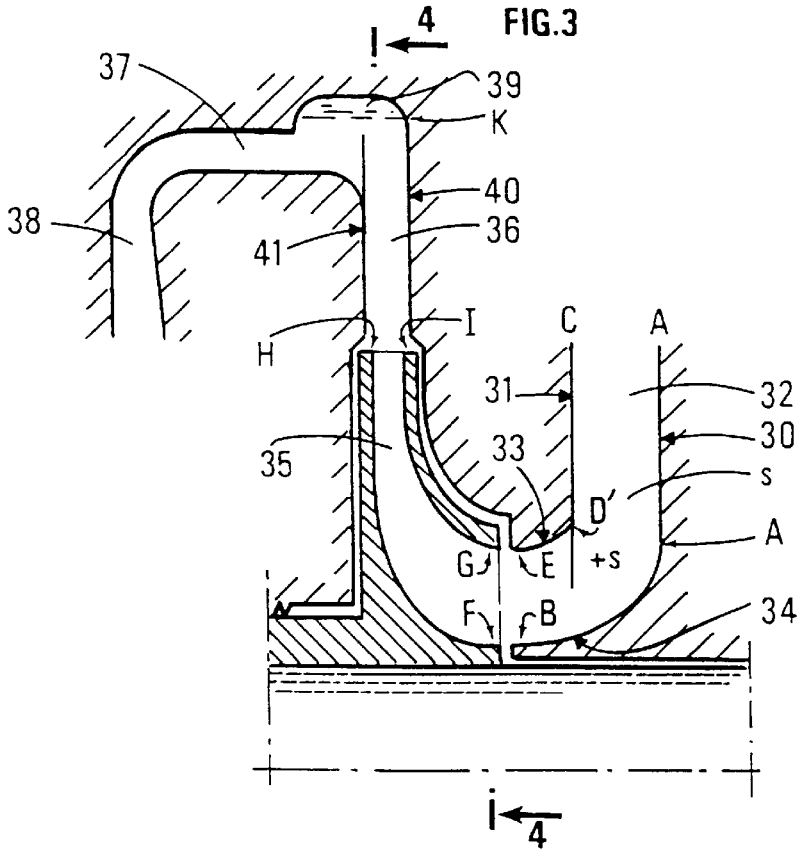
FIG.4
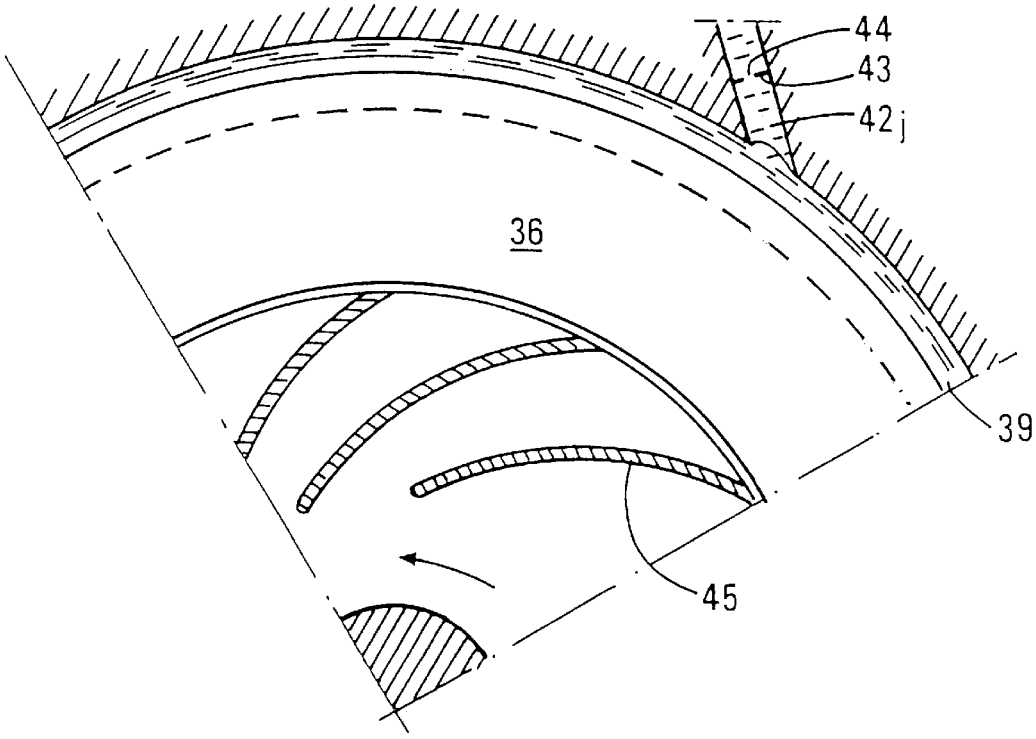

SINGLE-SHAFT COMPRESSION-PUMPING DEVICE ASSOCIATED WITH A SEPARATOR

FIELD OF THE INVENTION

The present invention relates to a compression-pumping system designed for a multiphase fluid comprising at least one liquid phase and at least one gas phase.

BACKGROUND OF THE INVENTION

It is well-known that it is possible to impart energy to a multiphase fluid or to a mixture of gas and liquid by means of various machine types.

Whatever the design of the rotodynamic pumps used, and more particularly single-phase type pumps, good results are obtained when the value of the gas-liquid volume ratio under real given pressure and temperature conditions (GLR in abbreviated form) of the fluid is low.

Pumping of a liquid-gas mixture by means of radial impellers is thus generally limited to gas proportions below 20%. This limit can be brought to about 30% in the case of radio-axial impellers and to about 40% with axial impellers.

The prior art also describes pumping devices having characteristics suited to pumping of a multiphase fluid. For example, the applicant's patent FR-2,665,224 describes a geometry of the cross-section of flow for a multiphase fluid that is delimited by two successive blades, suited to impart energy to a multiphase fluid in order to compress fluids whose GLR value ranges for example between 0 and 20.

However, the pumping or compression efficiency for such a fluid varies considerably according to the conditions in which the fluid notably is. This efficiency tends to decrease when the two-phase fraction increases and when the ratio of the density of the gas to the density of the liquid decreases. Besides, the single-phase performances of these impellers that serve as a reference for determination of the two-phase performances are substantially lower than those of radial impellers, in particular the efficiency and the manometric head delivered per stage.

Furthermore, it is often necessary to use several machines positioned in series in order to obtain the desired compression ratio.

Using several single-phase machines (pump and compressor) or several multiphase type machines leads to bulky and expensive compression installations.

SUMMARY OF THE INVENTION

The compression system according to the invention consists in including in the same device the elements required for separation of the liquid and gas phases and for compression of each of these phases. It notably consists in using a device comprising a pumping section and a compression section whose impellers are secured to the same shaft, these two sections are associated with a gas-liquid separator for producing an essentially liquid fluid and an essentially gaseous fluid. The compression system thus defined is associated with a control circuit. The separator has a reduced volume in relation to the prior art.

The present invention relates to a compression-pumping system for a multiphase fluid (GLR) comprising in combination at least the following elements:

- a compression section suited to compress an essentially gaseous fluid,
- a pumping section suited to impart energy to an essentially liquid fluid,

- a shaft A,
- seal means between the compression section and the pumping section,
- a separator allowing to obtain an essentially liquid fluid and an essentially gaseous fluid,
- various delivery or discharge pipes for the multiphase fluid and/or each of the phases of said multiphase fluid coming from the separator.

The system is characterized in that:

- the shaft is common to the compression section and to the pumping section,
- the pumping and compression sections are included in the same enclosure.

It comprises for example at least one system for controlling the level of liquid in the separation device.

The liquid level control system can comprise a means for detecting the liquid level and it allows to control and/or to act on the liquid and/or gas flows coming from the separator according to the level of the gas-liquid interface in the separator.

The control system can comprise a series of valves and bypass lines including at least:

- a pipe for recycling part of the gas coming from the compression section, said pipe being equipped with a control valve,
- a pipe for recycling a liquid fraction, said liquid fraction coming from the pumping section and said pipe being equipped with a control valve,
- a detector allowing to detect the liquid level in the separator,
- data processing and signal generation means (M).

The separator is for example a static separator.

The static separator can be associated with at least one of the following elements:

- a helical pipe placed inside said static separator,
- a first stage of the compression section suited for separation of the droplets and of the gas,
- several disks (Dl, Dg) mounted on said shaft, said shaft extending in said separator over at least part of its length,
- a cyclone type device, said elements can be used alone or combined with each other.

The number of impellers for the compression section and for the pumping section and the specific speed of the impellers corresponding to the compression section are for example selected so as to have:

$$\frac{N_{s,gas}}{N_{s,liq}} = GLR\left(1.3\,\frac{Nb_g}{Nb_l}\,\frac{\rho_g}{\rho_l}\right)^{3/4}$$

substantially close to 1.

The separator can be secured to the enclosure or included therein.

The system according to the invention advantageously finds applications for multiphase petroleum effluent transportation.

Using the system according to the invention notably allows to:

- reduce the number of machines in comparison with single-phase and multiphase machines,
- reduce the number of impellers in comparison with multiphase compression,
- reduce the power consumption in comparison with conventional two-phase or multiphase machines.

BRIEF DESCRIPTION OF THE DRAWINGS

Other features and advantages of the system according to the invention will be clear from reading the description hereafter of a non limitative example, with reference to the accompanying drawings wherein.

DETAILED DESCRIPTION OF THE INVENTION

Figure 1:
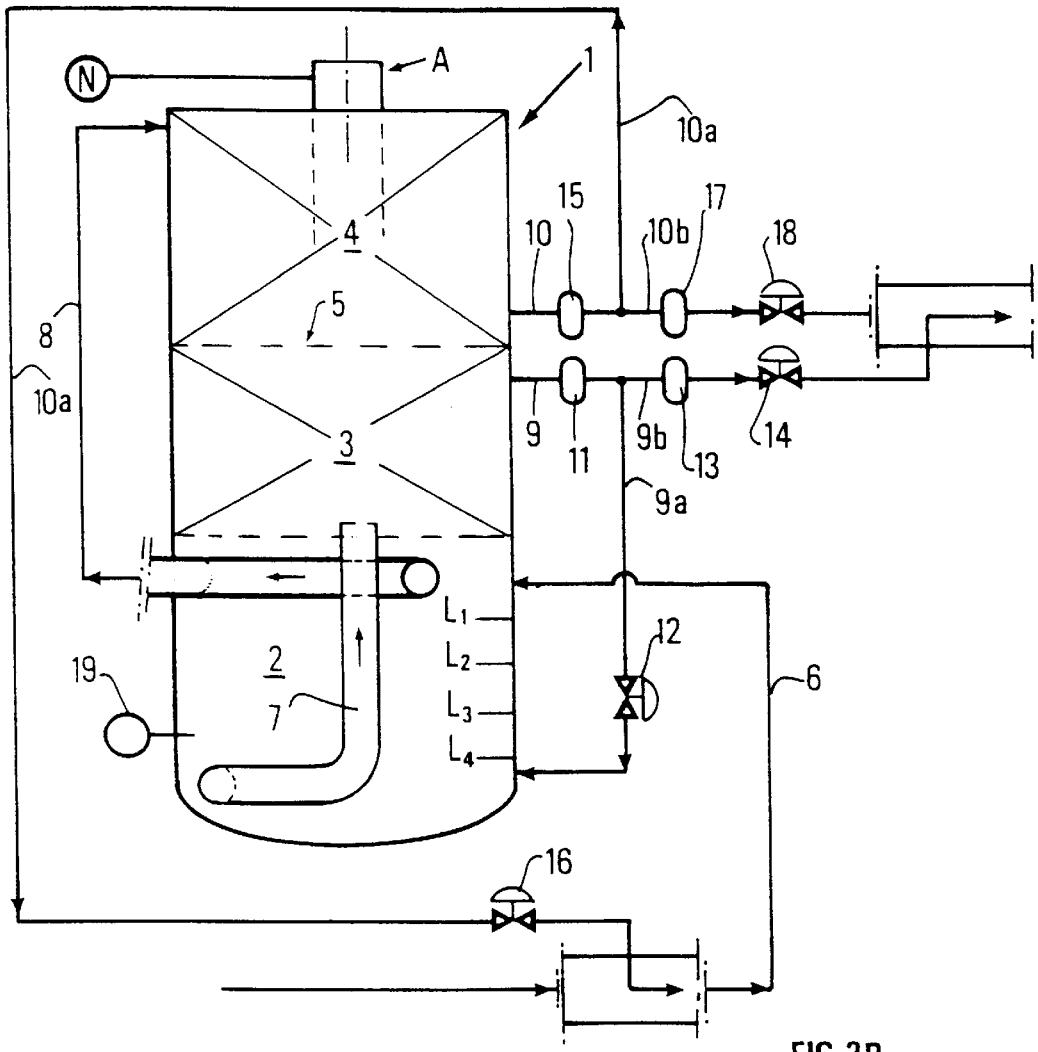
FIG. 1 schematizes the principle of the system according to the invention and of the working thereof, and shows a part allowing compression of each of the phases of the fluid and a fluid flow control circuit.

The integrated compression-pumping system shown by way of non limitative example in FIG. 1 comprises compression and pumping sections associated with a separator and with a circuit controlling the amounts of each of the phases of the multiphase fluid, the gas phase and the liquid phase.

In the description, the expression <<gas phase>> refers to an essentially gaseous fluid or to a gas coming from the separation stage, and the expression <<liquid phase>> refers to an essentially liquid fluid or to a fluid coming from the separation stage, and vice versa.

The integrated compression-pumping system allowing to impart an energy value to the multiphase fluid comprises, in a single enclosure or casing 1, a separation device 2 or separator, a pumping section 3, suited to impart a pressure value to an essentially liquid effluent or to a liquid, and a compression section 4 selected to compress an essentially gaseous fluid or a gas.

The separator can be secured to the enclosure, included in or separate from the enclosure.

The impellers of compression section 4 and pumping section 3 are secured to the same shaft A. These two sections are tightly separated by means 5, a particular but non limitative example of which is given in FIG. 2.

Casing 1 is provided with several pipes allowing delivery or discharge of the various fluids:

- a main delivery pipe 6 for the multiphase fluid to be compressed,
- a pipe 7 placed between separator 2 and pumping section 3, allowing passage of the liquid,
- a pipe 8 placed between separator 2 and compression section 4 allowing passage of the gas,
- a pipe 9 allowing to discharge the liquid coming from pumping section 3, and
- a pipe 10 allowing to discharge the compressed gas coming from compression stage 4.

Liquid discharge pipe 9 is equipped with a flow metering device 11 and it divides into at least two lines 9*a*, 9*b*. Line 9*a* designed for recycle of a fraction of the liquid is provided with a valve 12 controlling the liquid fraction recycled. Line 9*b* allows to discharge the non recycled liquid fraction or all of the compressed liquid, this line being provided with a control valve 14 and possibly with a flowmeter 13.

Compressed gas discharge pipe 10 in compression section 4 comprises a device 15 capable of measuring the amount of gas and it divides into two lines 10*a*, 10*b*. Line 10*a* for recycling a fraction of the gas is provided with a valve 16 designed for control of the recycled gas fraction and joins the main production delivery pipe. Line 10*b* designed for discharge of the non recycled gas fraction or of all of the gas is provided with a gas flow control valve 18 and possibly with a device 17 intended to measure the amount of non recycled gas.

The two lines 9*b*, 10*b* designed for discharge of the non recycled gas and liquid can be joined in order to transfer in a single line the multiphase fluid after passage through the compression-pumping system, this fluid consisting of the gas phase and of the liquid phase respectively coming from the compression section and from the pumping section, to a given point of destination not shown in the figure.

The various pipes and lines are for example equipped with pressure detectors. Pressure detectors Cp are for example placed on the gas discharge line and at the level of the separator.

Shaft A is provided with a means allowing to determine its rotating speed N using devices known to the man skilled in the art.

The separator comprises one or more liquid level detectors 19*i*. When the separator comprises a single detector, the latter can follow the complete evolution of the liquid level in the separator.

The various measuring devices and the flow control valves are for example connected to a control means such as a microcontroller (not shown in the figure) capable of processing the various data coming from the detectors and of generating signals in order to control opening and closing of the valves.

The compression-pumping system equipped with the liquid level control system can for example work as follows:

The control principle consists in maintaining a substantially constant liquid level in the separator, a minimum flow rate in the compression section so as to protect this section against flow fluctuations that may damage the material at reduced flow rate and a minimum flow rate in the pumping section so as to limit the vibrations likely to appear at reduced flow rate.

Control of the liquid level in the separator comprises measuring the level for example by means of detector 19. This control is intended to maintain the liquid level around a reference position $L_3$.

Four threshold levels $L_1$, $L_2$, $L_3$ and $L_4$ are for example defined in the separator in order to explain the working principle of the invention by way of non limitative example.

The detector designed for level measurement in the separator determines the real level L of the liquid fraction. This information is sent to the microcontroller which compares this value for example with reference value $L_3$.

Under normal working conditions, the situation is as follows:

For the compression section, gas outlet valve 18 is entirely open and recycling valve 16 is entirely closed, For the pumping section, liquid outlet valve 14 is partly closed and recycling valve 12 is partly open, the closing and opening degrees increasing with the average production GLR so as to prevent a sudden and relatively considerable liquid inflow (in relation to normal working conditions). With this method of operation, valves 14 and 12 are, in the case of a low average production GLR, slightly oversized in relation to normal liquid production and, in the case of a high average production GLR, greatly oversized in relation to normal liquid production.

The expression <<average production GLR>> defines a determined GLR value.

The control mode is suited to the difference between the real measured level L and level $L_3$.

When level L tends to exceed $L_3$, the microcontroller acts so that valve 12 tends to close and valve 14 tends to open.

When level L becomes lower than $L_3$, the opposite logic is applied.

When L becomes greater than $L_2$, the microcontroller acts so that valve 18 tends to close, valve 12 closes entirely and valve 14 opens entirely.

When L becomes greater than $L_1$, the signals generated by the control means allow to obtain the following effects: valve 18 continues to close, valve 16 tends to open and the speed of the shaft tends to decrease so as to prevent a liquid phase inflow in the gas section.

When L becomes lower than $L_4$, the action of the microcontroller is such that valve 12 opens entirely and valve 14 closes entirely so as to prevent a gas phase inflow in the liquid section.

The reliability of the level measurement in the separator being essential for protection of the rotating elements, level measurement can be performed by means of three detectors working according to the principle of a majority logic (when a detector provides information that is different from that provided by the two others, the information provided by the first one is dismissed to the profit of the two others).

Lines 9*a* and 10*a* also act as a protection for the compression section or the pumping section against operation at a relative flow rate lower than a flow rate generating pressure fluctuations.

In order to anticipate the inflow of a liquid plug or of a large volume of liquid and to allow better protection of the multiphase production equipment, a liquid rate measuring system can be installed upstream from the equipment so as to anticipate actions on the valves and on the velocity control.

Fuzzy logic control, known to the man skilled in the art, which takes account of the liquid level in the separating drum, of the position of the various recycling or liquid and gas flow control valves, of the volume of liquid and of its displacement velocity upstream from the compression-pumping system, can be applied so as to allow better smoothing of the production in relation to a conventional control while providing a better equipment protection. This volume of liquid is evaluated by the liquid rate measuring system.

The characteristics of the pumping section and compression section hydraulics, notably those of the first stage, are selected for example according to the upstream separator type.

FIGS. 2, 2A, 2B and FIG. 6 schematize, by way of non limitative illustration, examples of primary static separators or separators allowing improved separation.

Figure 2A:
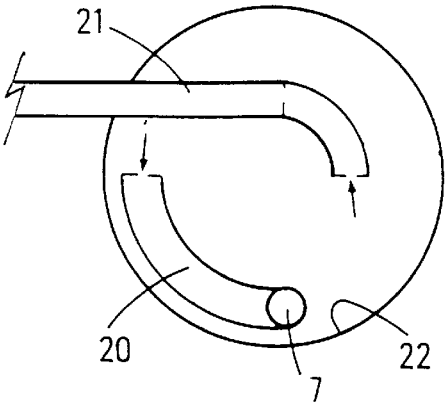
FIGS. 2 and 2A show an integrated compression-pumping system comprising a static separator.
Figure 2B:
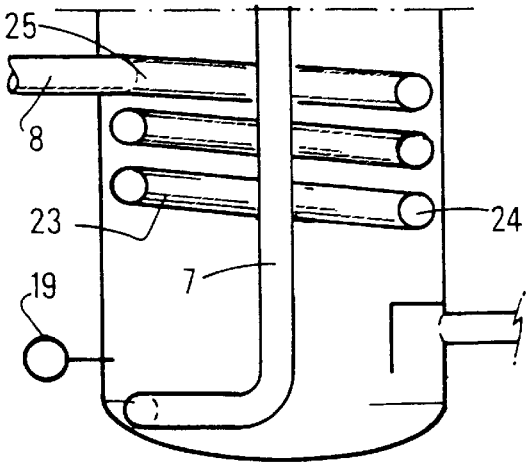
FIG. 2B shows an example of improvement of this static separator, FIGS. 3 and 4 schematize a radial view and an axial view of an example of an inlet stage of the compression section also used as a gas-liquid separation system at the discharge end of the impeller.
Figure 2:
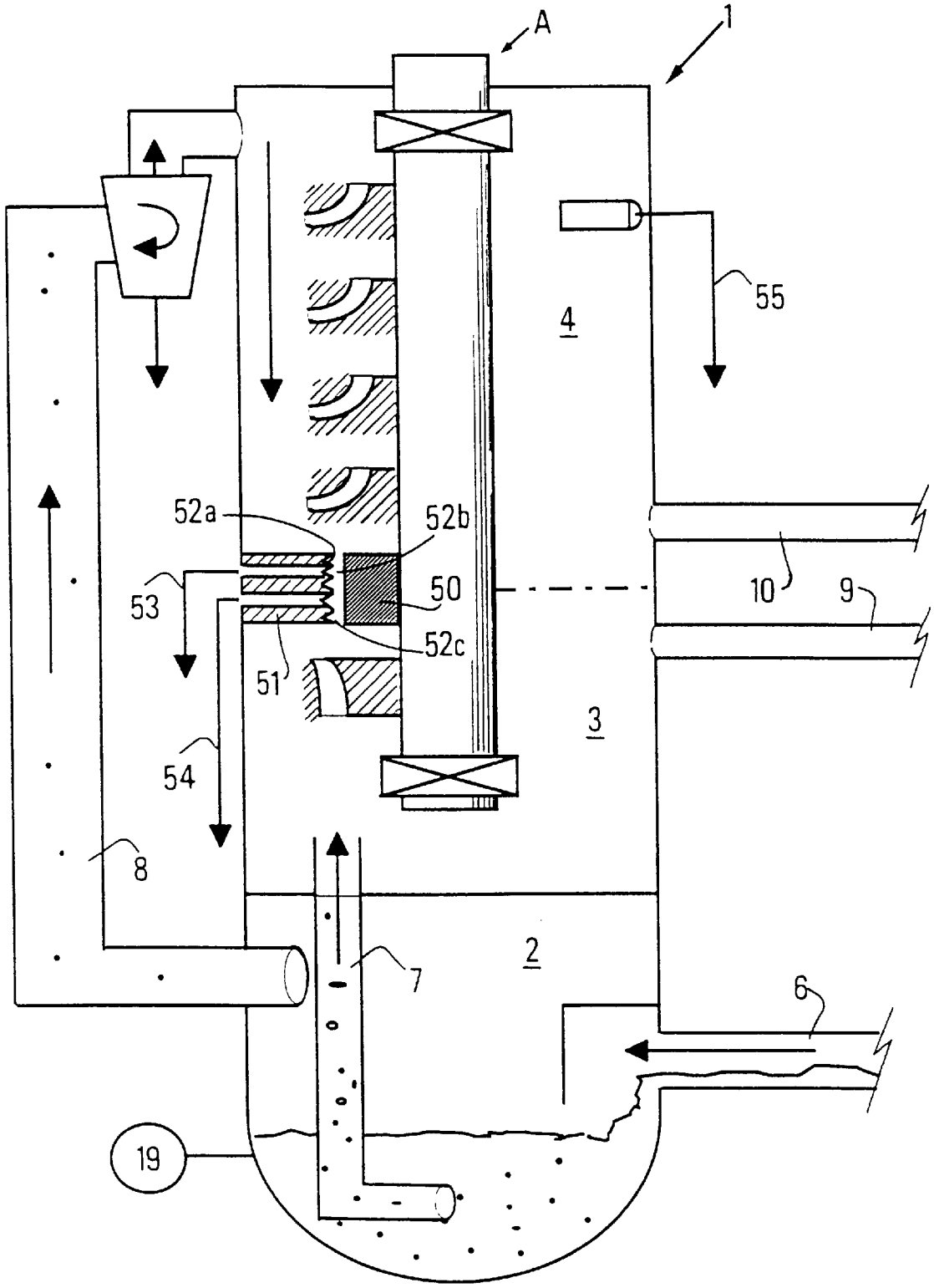
Figure 3D:
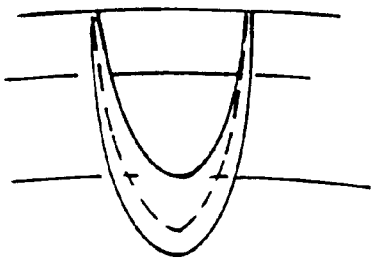
FIGS. 3A, 3B, 3C and 3D show in detail another embodiment example for the inlet and outlet lines of a stage described in FIG. 3, FIG. 5 schematizes the absolute and relative velocities of the liquid and gas phases at the inlet of the first compression stage.
Figure 3C:
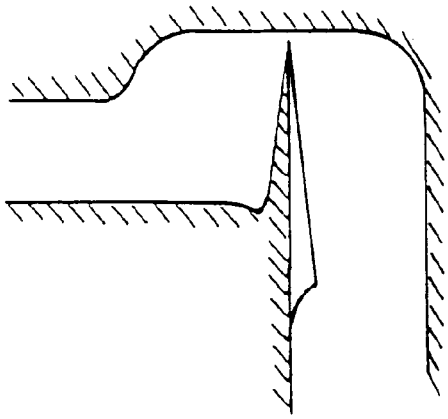
Figure 3B:
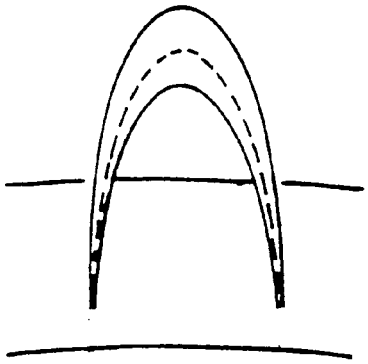
Figure 3A:
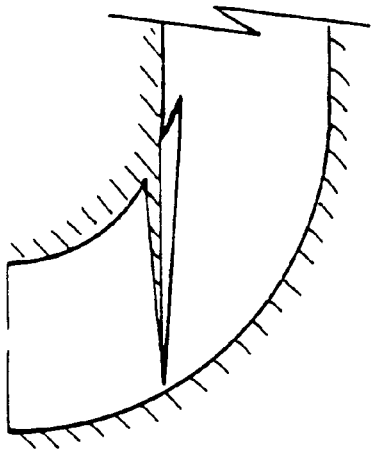

FIG. 2 describes an example of a compression-pumping system equipped with a static separator having a reduced volume in relation to the dimensions of the separators conventionally used in the field of multiphase production.

In order to accelerate separation of the liquid phase and of the gas phase, various gas-droplet separator types can be placed upstream from the compression section.

FIG. 2A shows an example of layout of two tubes (20, 21) placed in the separator, which contribute to activating separation of the bubbles in the liquid phase and of the droplets in the gas phase.

A tube 20 is placed in the static separator so as to achieve tangential suction of the liquid, along the inner wall 22 of the separator, and to induce a rotational motion of the liquid. The inlet of tube 20 is situated below level $L_4$.

Similarly, suction of the gas is performed tangentially to the inner wall of the separator in order to activate separation of the droplets in the gas phase. The droplets settling on wall 22, suction occurs through tube 21 at an intermediate radius between the axis of rotation and the wall. The inlet of tube 21 is situated above level $L_1$.

FIG. 2B schematizes another example of a separator described in FIG. 2. The improvement consists in placing, inside the static separator, gas phase and liquid phase suction lines allowing to obtain practically total separation of the phases.

In this figure, a helical pipe 23 is placed around the central tube allowing passage of the liquid phase to the pumping section. The gas containing the liquid droplets flows in through inlet 24. As it flows through the helical pipe, the droplets settle along the wall of the pipe under the action of a centrifugal force. The pipe being ascending in this non limitative example, the deposited liquid falls back into the separator through gas inlet 24 while the gas flows out at point 25 (inlet of pipe 8). The characteristics of the helical pipe (pipe diameter, radius and slope of the helix) are dimensioned so as to allow the deposited liquid to fall down through inlet 24.

Seal device 5 shown in FIG. 2, which separates the compression section and the pumping section, is advantageously suited to prevent migration of the gas towards the liquid and conversely of the liquid towards the gas.

The seal device consists for example of a cylinder 50 mounted on shaft A and of a fixed cylindrical wall 51 mounted on casing 1. These two parts 50, 51 are for example separated by a row of labyrinths 52*a*, 52*b*, 52*c*. Fixed wall 51 is pierced with two pipes 53, 54 for example designed for passage of the leak currents coming from the compression section and from the pumping section, and flowing back to the separator. This flow occurs along labyrinths 52*a* and 52*c*. One of the purposes of labyrinths 52*b*, placed between the two pipes, is to prevent mixing of the leak currents at the level of the cylindrical walls and consequently to provide perfect sealing between the two sections.

The leak currents notably depend on the number and on the shape of the labyrinths, on the clearance between them and rotating cylinder 50, on the diameter of this cylinder and on the differential pressure between the pumping section or the compression section and the separator.

The characteristics of the first stage of the compression section can be determined to prevent or limit erosion due to the velocity of the liquid droplets remaining after primary separation.

FIGS. 3 and 4 (radial section in the plane of the impeller) schematize an embodiment example of the first stage of the compression section, advantageously used when the upstream separator performs a primary type separation.

The essentially gaseous fluid containing liquid droplets is fed into the first compression stage through inlet line 30 delimited by two substantially rectilinear and parallel walls 31 (C-D) and 32 (A-A'). Walls 33 (D'-E) and 34 (A'-B) form an extension of these two walls respectively. Walls 33 and 34 have a radius of curvature <<r>> selected to generate a centrifugal force that allows separation of the liquid phase and of the gas phase. Wall 31 is provided with a means whose purpose is to allow passage of the liquid phase towards wall 32 as described hereafter. This means can be an extension of wall 31 up to a salient point <<s>> (FIG. 2) or a gutter <<g>> (FIGS. 2A to 2D) with a shape suited for transfer of the liquid phase from outer wall 33 to inner wall 34.

In the rest of the description hereafter, the expression <<inner wall>> (34, 41) refers to the wall of the inlet line that is closer to shaft A and the expression <<outer wall>> (33, 40) refers to the wall that is farther from this shaft.

The wet gas flows through inlet line 30 as described hereunder.

The essentially gas phase containing liquid droplets is centrifuged in the curved part of the inlet line delimited by walls 33 and 34, which is contained between points A' and D and E, B.

These liquid droplets settle on curved inner wall 34 as a result of centrifugation.

The liquid phase streaming down wall 31 in the form of a liquid film is carried along by the gas phase:

- to salient point <<s>> (FIG. 3) from which it comes off in the form of droplets prior to being transferred to wall 34, or
- into gutter <<g>> (FIGS. 3A to 3B) in which it flows onto inner wall 34.

The liquid film present on wall 34 comes off in the form of liquid droplets at point B because of the gap existing between fixed inlet line 30 and rotating impeller 35.

These droplets flow into impeller 35 placed downstream from the inlet line at the point where the distance to the axis of rotation is the shortest and consequently at the point where the peripheral speed of the impeller is the lowest.

Impeller 35 is a conventional radial impeller. During its rotation, the liquid and gas phases are centrifuged from the impeller inlet FG to the inlet IH of the stator line or outlet line situated downstream from impeller 35.

The outlet line comprises a diffuser 36, a curved line 37 and a return diaphragm 38.

Curved line 37 is suited for separation of the liquid phase and of the gas phase. It comprises a collecting channel 39 and a means as described above, for example a salient point <<s>> (FIG. 3) or a gutter <<g>> (FIGS. 3C to 3D), positioned at the level of wall 41, for example at the diffuser outlet, allowing passage of the liquid phase into collecting channel 39.

The gas phase and the liquid phase flow as follows at the level of the outlet line:

- the liquid phase dispersed in the gas phase and flowing into diffuser 36 is collected in collecting channel 39 where it undergoes a tangential movement (in the direction of rotation of the impeller) as it is carried along by the gas phase,
- the gas phase of lower density continues to flow through radial return diaphragm 38 towards the second compression stage,
- the liquid partly flowing on the walls of the diffuser:
  - for wall 40, directly after streaming over the length thereof, and
  - for wall 41, after coming off of the liquid in the form of droplets at salient point <<s>>, or after flowing through gutter <<g>>, flows into collecting line 39. The liquid phase dispersed in the gas phase is centrifuged at the outlet of diffuser 36 in the axial plane in the direction of collecting channel 39. As a result of the movement of the gas in the radial plane, the liquid undergoes a tangential movement in channel 39 in the direction of rotation of the impeller. This rotating movement of the liquid in the axial plane allows it to remain in collecting channel 39.

The pressure of the liquid collected in channel 39 being higher than the input pressure of the impeller (and consequently than the pressure of the separator), it allows discharge of the liquid into the separator by means of pipes 42*j*, then of pipe 55 (FIG. 2). Pipes 42*j* are for example equipped with means allowing flow control of the liquid to be discharged. These means can be a plate 43 provided with one or more orifices 44. Orifices 44 are preferably dimensioned so as to provide discharge of the liquid and to prevent obstruction of channel 39.

Such a compression stage advantageously allows to eliminate the possible presence of liquid resulting from the primary separation. At the outlet of this first compression stage, the fluid is nearly gaseous and liquid-free, which allows to use impellers with conventional characteristics in the compression stages downstream from the first stage.

Figure 5:
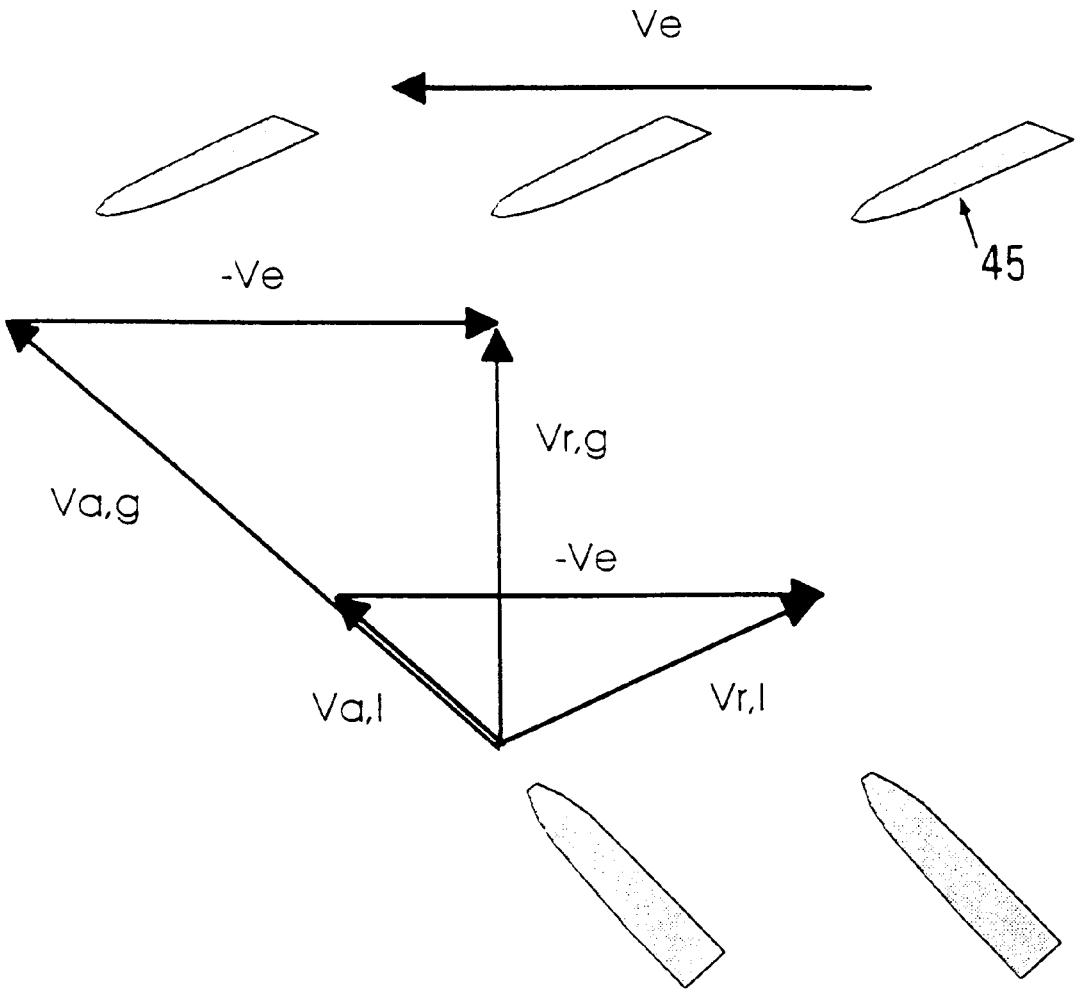

FIG. 5 shows, in the triangle of velocities at the impeller inlet, the various velocity components for the droplets and the gas.

In order to decrease the relative velocity of the droplets in relation to the impeller still further (i.e. the velocity of impact on blades 45 (FIG. 4) of the hydraulics), the flow of the essentially gaseous phase is directed to a cylinder of revolution in the direction of rotation of the impeller.

The cylinder of revolution can be defined at each outlet point at the level of the line, for example between points B and E (FIG. 3) by the shaft and the radius of the cylinder considered between B and E.

The local relative velocity $V_{r,1}$ of the droplets in relation to the impeller blades is determined by the absolute velocity $V_{a,g}$ of the gas phase, the slip between the gas phase and the droplets, the orientation of the absolute velocity of flow and of the drive speed $V_e$.

Considering the flow complexity, calculation of the local relative velocity is carried out from a two-phase three-dimensional calculation code known to the man skilled in the art.

The allowable velocity of impact is determined according to the diameter of the droplets, the material forming or deposited on the impeller blades and the erosion rate that should not be exceeded. The acceptable erosion rate is a data that is specified according to the minimum production time and to the conditions of maintenance of the machine.

The hydraulics of the pumping section situated downstream from a static separation are selected to prevent or limit cavitation effects that might result from the presence of the gas phase. Cavitation effects are for example attenuated by placing the separator at a higher level than the essentially liquid section and by using a first impeller with blades having a small radius of curvature or a helico-axial type impeller such as that described in one of the applicant's patents FR-2,333,139, FR-2,471,501 and FR-2,665,224.

Figure 6:
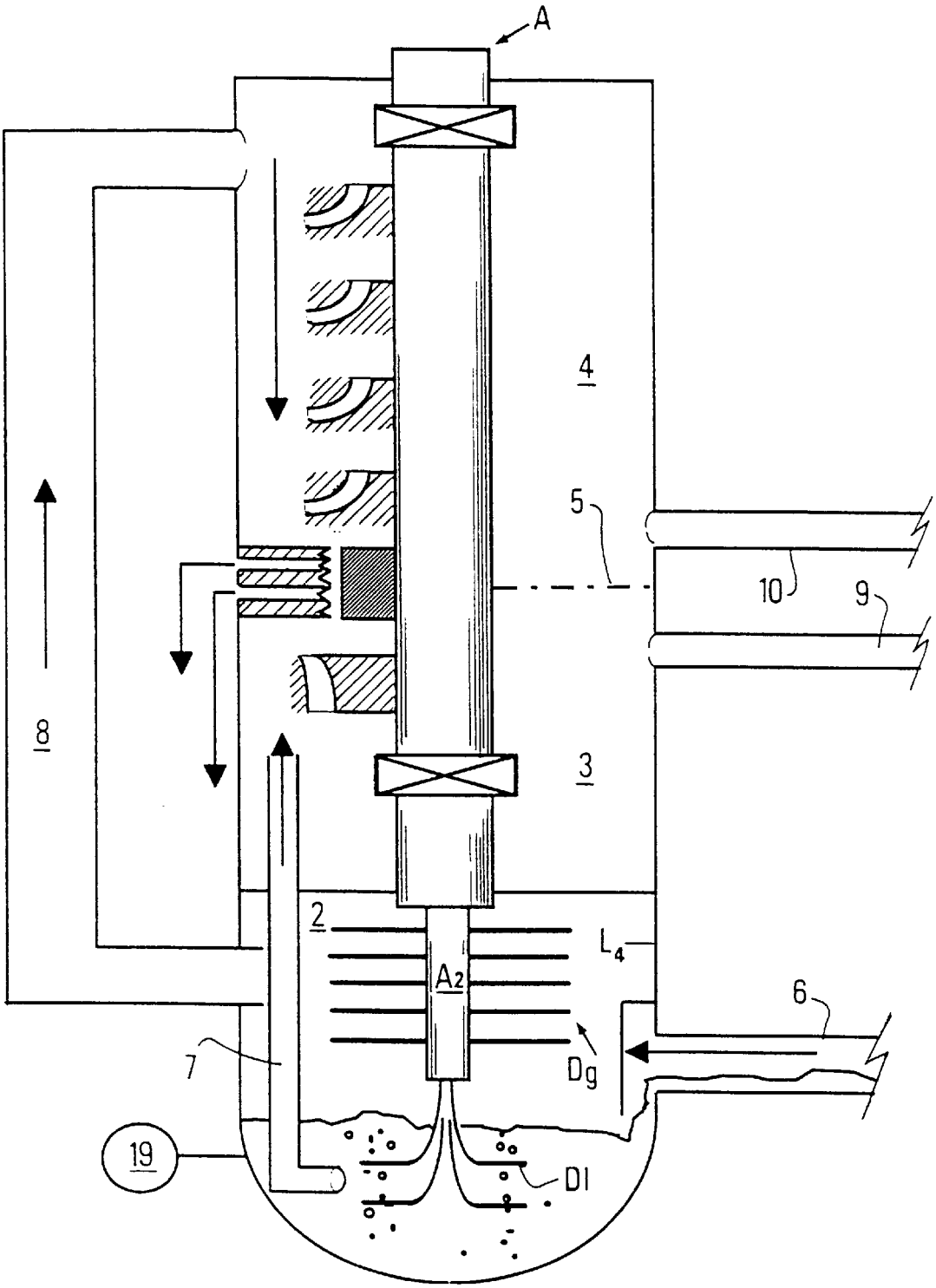
FIG. 6 shows another variant of the system according to the invention associated with a dynamic separator.

FIG. 6 shows another embodiment variant where the separation is a dynamic type separation.

In this example, shaft A common to the pumping section and to the compression section enters the static separator of FIG. 2 and serves as a support for two series of disks Dg, Dl.

The rotation of the disks drives the liquid phase and the gas phase into rotation in the separator. Under the effect of the centrifugal forces thus generated, the bubbles are carried along to the center of the separator, whereas the heavier droplets are driven towards the inner wall of the separator.

The diameter of part A2 of the shaft supporting disks Dg and Dl is dimensioned according to the torque to be transmitted and to the required rigidity. The shaft can consist of two elements that are coupled together by gear coupling, flexible, magnetic coupling or others.

Disks Dg are for example located at a first end of part A2, the upper end. They are placed above level $L_1$, so as to prevent working of the disks at the level of the oil-gas interface and formation of an emulsion.

Disks Dl are secured to the second end of part A2. They are located below level $L_4$. The geometric and dimensional characteristics of disks Dl are designed to allow discharge of the bubbles at the level of the axis of rotation of the disks, as shown in FIG. 6.

The diameter of disks Dg or Dl and the distance between the disks of the same series can be determined according to the desired degree of separation upstream from the pumping and compression sections. For example, these parameters will be determined according to the limiting diameter values for the bubbles and the droplets. These parameters can be calculated by means of a three-dimensional calculation code known to the man skilled in the art.

In the aforementioned embodiment examples, certain conditions must preferably be met in order to obtain the best compression system efficiency, notably the value of the ratio of the number of impellers of the pumping section to that of the compression section, and the specific speed for the impellers of the compression section and/or of the pumping section.

The following data are known for a given multiphase fluid:

$p_g$, $p_l$, which correspond to the density of the gas phase and of the liquid phase, the GLR ratio, which can be estimated before the fluid enters the separator.

The specific speed of the impeller in the compression section is selected:

$$N_{sg}=N\sqrt{Q}/H^{0.75},$$

by imposing for example a manometric head for the impeller hydraulics and by selecting a value for the rotating speed N, flow rate Q being imposed by the production, so that this speed value is included in a given value range.

For a radial impeller for example, in the case of a wet gas compression, the maximum efficiency is reached when the specific speed ranges between 70 and 100 (known to the man skilled in the art—with N, the rotating speed in rpm, Q the volume flow rate in cusec and H the manometric head in ft).

The number of impellers for the pumping section and the compression section, Nbe, and $Nb_g$, is determined in order to have a specific speed ratio:

$$\frac{N_{s,gas}}{N_{s,liq}} = GLR\left(1.3\,\frac{Nb_g}{Nb_l}\,\frac{\rho_g}{\rho_l}\right)^{3/4}$$

close to 1,

GLR, $Nb_g$, $Nb_l$, $\rho_g$, $\rho_l$, being respectively the ratio of the volume flow rates of the gas and liquid phases, the number of impellers in the gas and liquid sections, and the density of the gas and liquid phases.

In order to reach a minimum energy consumption, the average diameter and the number of impellers of each section, as well as the rotating speed of the shaft, are consequently adjusted so as to satisfy the specific speed relations described above.

More generally and without departing from the scope of the invention, separation of the liquid phase and of the gas phase can be achieved by means of a static separator that can be associated at least with one of the following elements:

an equipment internal to the static separator as described in FIG. 2B, a means allowing <<dynamic>> separation as described in FIG. 6, using for example a series of disks, using a cyclone type separator, fitting of the inlet impeller of the compression section having two functions, a function of separation of the liquid droplets from the gas phase and a function of gas compression.

The advantage of the compression-pumping system mainly lies in the reduction of the number of rotating machines.

1—It allows to use a single machine instead of two distinct machines: single-phase pump and compressor, while obtaining substantially identical results.

2—It allows several multiphase machines to be replaced for a single rotating machine as shown in the tables hereunder.

The results have been obtained by means of the following comparison basis:

molecular mass of the gas: 25 compression ratio (output and input pressure ratio): 3 inlet temperature: 40° C.

The number of impellers required under these conditions for the compression-pumping system according to the invention is:

6 for the compression section, 1 for the pumping section when the input pressure<2.5 MPa abs and 2 when the input pressure>2.5 MPa abs.

For a multiphase machine of the type described in one of the applicant's patents FR-2,333,139, FR-2,471,501 and FR-2,665,224

| Input pressure in MPa abs | 1 | 2 | 3 | 4 |
|---|---|---|---|---|
| Number of multiphase impellers | 28 | 34 | 39 | 43 |
| Number of multiphase pumps | 2 | 3 | 3 | 3 |

Case GLR=40

| Input pressure in MPa abs | 1 | 2 | 3 | 4 |
|---|---|---|---|---|
| Number of multiphase impellers | 43 | 50 | 54 | 57 |
| Number of multiphase pumps | 3 | 4 | 4 | 4 |

What is claimed is:

1. A compression-pumping system for a multiphase fluid (GLR) comprising in combination at least the following elements:

a compression section (4) suited to compress an essentially gaseous fluid, a pumping section (3) suited to impart energy to an essentially liquid fluid, a shaft (A)

seal means (5) between compression section (4) and pumping section (3), a separator (2) allowing to obtain an essentially liquid fluid and an essentially gaseous fluid, various delivery or discharge pipes (6, 7, 8, 9, 10) for the multiphase fluid and/or each of the phases of said multiphase fluid coming from the separator, wherein:

the shaft is common to compression section (4) and to pumping section (3), pumping section (3) and compression section (4) are included in the same enclosure (1).

2. A system as claimed in claim 1, characterized in that it comprises at least one system designed to control the amount of liquid inside the separation device.

3. A system as claimed in claim 2, characterized in that said control system comprises a means for detecting the liquid level and allows to control and/or to act on the liquid and/or gas flows coming from the separator according to the level of the gas-liquid interface in the separator.

4. A system as claimed in claim 3, characterized in that said control system comprises a series of valves and bypass lines including at least:

a pipe (10*a*) for recycling part of the gas coming from the compression section, said pipe being equipped with a control valve (16), a pipe (9*a*) for recycling a liquid fraction, said liquid fraction coming from the pumping section and said pipe (9*a*) being equipped with a control valve (12), a detector allowing to detect the liquid level in separator (2), data processing and signal generation means.

5. A system as claimed in claim 1, characterized in that the separator is a static separator.

6. A system as claimed in claim 5, characterized in that said static separator is associated with at least one of the following elements:

a helical pipe (23) placed inside said static separator, a first stage of the compression section, suited for separation of the droplets and of the gas, several disks (Dl, Dg) mounted on said shaft, said shaft extending in said separator over at least part of its length, a cyclone type device, said elements can be used alone or combined with each other.

7. A system as claimed in claim 1, characterized in that the number of impellers for the compression section and for the pumping section and the specific speed of the impellers corresponding to the compression section are selected so as to have $$\frac{N_{s,gas}}{N_{s,liq}} = GLR\left(1.3\,\frac{Nb_g}{Nb_l}\,\frac{\rho_g}{\rho_l}\right)^{3/4}$$

substantially close to 1.

8. A system as claimed in claim 1, characterized in that said separator (2) is secured to enclosure (1).

9. A system as claimed in claim 1, characterized in that said separator (2) is included in said enclosure (1).

10. Application of the compression system as claimed in claim 1 for transportation of multiphase petroleum effluents.

* * * * *